United States Patent [19]

Williams et al.

[11] Patent Number: 4,719,030

[45] Date of Patent: Jan. 12, 1988

[54] TRANSPARENT OR TRANSLUCENT TOILET SOAP BARS CONTAINING WATER-INSOLUBLE SILICA OR SILICATES

[75] Inventors: Michael K. Williams, Newcastle upon Tyne; Geoffrey G. Dawson, Ponteland, both of England; Ralph F. Medcalf, Jr., Cincinnati, Ohio

[73] Assignee: The Procter & Gamble Company, Cincinnati, Ohio

[21] Appl. No.: 836,668

[22] Filed: Mar. 5, 1986

[30] Foreign Application Priority Data

Mar. 5, 1985 [GB] United Kingdom ..... 8505607

[51] Int. Cl.[4] ..... C11D 9/18; C11D 17/00

[52] U.S. Cl. ..... 252/133; 252/108; 252/131; 252/134; 252/174.25; 252/DIG. 16

[58] Field of Search ..... 252/131, 133, 134, 174.25, 252/DIG. 16, 108

[56] References Cited

U.S. PATENT DOCUMENTS

| | | | |
|---|---|---|---|
| 2,677,665 | 5/1954 | James | 252/131 |
| 2,686,761 | 8/1954 | Ferguson et al. | 252/109 |
| 3,408,299 | 10/1968 | Henry | 252/129 |
| 3,544,474 | 12/1970 | Shaffer | 252/131 |
| 3,899,447 | 8/1975 | McDonald | 252/539 |
| 4,163,732 | 8/1979 | Sai et al. | 252/99 |
| 4,256,600 | 3/1981 | Lewis et al. | 252/132 |
| 4,326,978 | 4/1982 | Moesch | 252/107 |
| 4,328,131 | 5/1982 | Carson et al. | 252/542 |
| 4,557,853 | 12/1985 | Collins | 252/128 |
| 4,574,053 | 3/1986 | Kinsman et al. | 252/134 |

FOREIGN PATENT DOCUMENTS

| | | |
|---|---|---|
| 93011 | 11/1983 | European Pat. Off. . |
| 132511 | 12/1920 | United Kingdom . |
| 160892 | 4/1921 | United Kingdom . |

OTHER PUBLICATIONS

McDonald, Louis, "Bar Soap Containing Silica Colloids", Soap/Chemical/Cosmetics Specialties, Jun. 1976, pp. 42, 44, 47, 50, 66.

*Primary Examiner*—Prince E. Willis

*Attorney, Agent, or Firm*—Ronald L. Hemingway; Richard C. Witte

[57] ABSTRACT

Detergent compositions in bar form comprising a water-insoluble, synthetic, amorphous, particulate silica or silicate having a specific surface area of at least 25 square meters per gram. The compositions are preferably milled toilet bars and demonstrate improved lathering, smear, cleansing performance and skin feel characteristics.

10 Claims, No Drawings

TRANSPARENT OR TRANSLUCENT TOILET SOAP BARS CONTAINING WATER-INSOLUBLE SILICA OR SILICATES

TECHNICAL FIELD

This invention relates to detergent compositions in the form of bars, tablets, sticks and the like. In particular, it relates to soap or soap/synthetic compositions in bar form for toiletry purposes having improved lathering and smear performance as well as modified skin-feel characteristics.

BACKGROUND

A wide variety of soap bar compositions and manufacturing processes are known in the art. Commonly, soap bar compositions for toiletry purposes are milled soaps of low moisture content (from about 5% to about 18% water) based on a mixture of tallow and coconut oil feedstocks. Bars having milled soap characteristics can also be prepared from soap of a high moisture content, as described for example in U.S. Pat. No. 2,686,761 and U.S. Pat. No. 2,970,116 by mechanically working the soap at a temperature of from about 80° F. to 125° F. and by using an appropriate fat feedstock. Such a process has two main advantages; firstly, it is relatively energy-efficient in that less drying of the neat-kettle soap is required; and secondly, it produces soap bars having desirable translucency or transparency as a result of beta-phase soap formation.

From the consumer acceptance viewpoint, of course, the lathering characteristics of a toilet bar composition are highly important and there is a continuing need to improve this area of performance. Traditionally, lather enhancement has been achieved in two ways. Firstly, shorter chain fatty acid soaps such as coconut soaps are known to produce a much richer lather than longer chain fatty acid soaps such as those based on tallow and it is therefore common practice in toilet bar manufacture to add up to 50% coconut soap to the tallow fat feedstock. Secondly, superfatting agents such as coconut fatty acid also improve the volume and richness of the lather when added to toilet bars in levels of up to about 10%. At higher levels, however, coconut soaps increasingly have a detrimental effect on bar mildness while fatty acids can produce undesirable softening of the bar. Moreover, coconut soaps and fatty acids are both expensive commodities and it would therefore be desirable to achieve improvements in lathering without recourse to high levels of these ingredients.

In the case of beta-phase soaps, moreover, there is a more fundamental difficulty in achieving high lathering. Fat feedstocks which are relatively rich in shorter chain (less than 16 carbon atoms) saturated fatty acids inhibit the formation of beta-phase soap and are therefore unsuitable for making transparent or translucent soap bars. In a similar way, beta-phase soap formation is also inhibited by the addition of free fatty acid superfatting agents in levels above about 1%–2%. For all these reasons, therefore, it has not been possible hitherto to achieve significant improvements in the lathering characteristics of beta-phase soaps.

Another drawback of beta-phase soaps is that they are relatively soft and display much poorer smear characteristics than traditional omega-phase soaps. Accordingly it would be highly desirable to improve the smear characteristics of beta-phase soap compositions.

It has now been discovered that the addition of defined low levels of certain water-insoluble silicas or silicates has a beneficial effect on bar lathering characteristics, both in soft and hard water conditions; that the lather benefits result even in the case of superfatted toilet bars based on a high coconut oil feedstock; that unexpectedly, the lathering improvement is achieved without detriment to beta-phase soap formation and without loss of transparency or translucency; that the smear characteristics of beta-phase soap bars is also markedly improved by use of the additives; that in addition, cleansing performance is improved; and, unexpectedly, that the skin-feel characteristics of the bar are also significantly modified.

The in-situ formation of water-insoluble silicas in detergent bars has previously been described in Soap/-Cosmetics/Chemical Specialities, June 1976, pp. 43 to 66. Silica levels of 9% or more were examined and lathering improvements in hard water were reported. By contrast, in the present invention lather benefits are observed both in hard and soft water but only in defined low additive levels, the benefit diminishing or disappearing outside the specified range.

SUMMARY OF INVENTION

Accordingly, the present invention provides a detergent bar composition comprising from about 0.1% to about 5%, preferably from about 0.1% to about 3.5% of water-insoluble synthetic amorphous particulate silica or silicate having a specific surface area of at least about 25 square meters per gram.

As used herein, the term detergent bar includes both conventional soap bar compositions and also mixed soap/synthetic bar compositions. Preferred compositions contain from about 45% to about 95% of soluble alkali metal soap of $C_8$–$C_{24}$, preferably $C_{10}$–$C_{20}$ fatty acids and from 0% to 45% of a synthetic anionic surfactant. In highly preferred compositions, the soap component constitutes from about 55% to about 88% and the synthetic anionic surfactant from about 0% to about 35% by weight of the composition. Especially preferred are milled toilet bar compositions which are essentially unbuilt (i.e. contains less than about 5% of a water-soluble surfactancy builder).

All percentages and ratios herein are by weight, unless otherwise specified.

Fatty acid soaps suitable for use herein can be obtained from natural sources such as, for instance, plant or animal esters (e.g., palm oil, coconut oil, babassu oil, soybean oil, castor oil, tallow, whale or fish oils, grease, lard, and mixtures thereof). The fatty acid soaps can also be synthetically prepared (e.g., by the oxidation of petroleum, or by the hydrogenation of carbon monoxide by the Fischer-Tropsch process). Resin acids, such as those present in tall oil, may be used. Naphthenic acids are also suitable.

Sodium and potassium soaps can be made by direct saponification of the fats and oils or by the neutralization of the free fatty acids which are prepared in a separate manufacturing process. Particularly useful in the present invention are the sodium and potassium salts of mixtures of fatty acids derived from coconut oil and tallow, i.e., sodium and potassium tallow and coconut soaps.

Tallow fatty acids can be derived from various animal sources and generally comprise about 1% to 8% myristic acid, about 21% to 32% palmitic acid, about 14% to 31% stearic acid, about 0% to 4% palmitoleic acid, about 36% to 50% oleic acid and about 0% to 5% linoleic acid. A typical distribution is 2.5% myristic acid, 29% palmitic acid, 23% stearic acid, 2% palmitoleic acid, 41.5% oleic acid, and 3% linoleic acid.

Coconut oil refers to fatty acid mixtures having an approximate carbon chain length distribution of: 8% $C_8$, 7% $C_{10}$, 48% $C_{12}$, 17% $C_{14}$, 8% $C_{16}$, 2% $C_{18}$, 7% oleic and 2% linoleic acids (the first six fatty acids listed being saturated). Other sources having similar carbon chain length distributions, such as palm kernel oil and babassu kernel oil, are included within the term coconut oil. Coconut oil fatty acids ordinarily have a sufficiently low content of unsaturated fatty acids to have satisfactory keeping qualities without further treatment. Generally, however, fatty acids are hydrogenated to decrease the amount of unsaturation (especially polyunsaturation) of the fatty acid mixture.

In one aspect of the invention, the compositions herein take the form of a milled toilet bar comprising from about 70% to about 88% of soluble alkali metal soap, wherein the soap comprises from about 20% to about 80% thereof of $C_8$–$C_{14}$ fatty acids and from about 20% to about 80% thereof of $C_{16}$–$C_{20}$ fatty acids, and wherein the bar additionally comprises from about 5% to about 18%, preferably from about 8% to about 13% water. In such compositions, generally at least about 25% of the $C_8$–$C_{14}$ fatty acid content is $C_{12}$ fatty acid. Highly preferred are compositions wherein the soap is derived from a mixture of from about 45% to about 65% tallow and from about 35% to about 55% coconut oil feedstocks, for example a mixture of about 50% tallow and about 50% coconut oil. Suitably the feedstocks are hydrogenated fatty acids having an iodine value (I.V.) of from about 1 to about 45. In such bars, the soap is generally in the omega phase.

In this aspect of the invention, the toilet bar compositions preferably also contain from about 2% to about 15%, preferably from about 5% to about 10% of free fatty acid containing from about 8 to about 20 carbon atoms, preferably from about 8 to about 14 carbon atoms with at least about 25% of the fatty acid containing 12 carbon atoms. The free fatty acid improves lather, skin emolliency and bar plasticity.

When the above compositions are prepared by neutralizing hydrogenated fatty acids, the compositions preferably additionally contain from about 1% to about 3% sodium chloride and the bar is preferably formed by milling the ingredients at a temperature of from about 43° C. to about 60° C., more preferably from about 43° C. to about 52° C.

In a second aspect of the invention, the compositions herein take the form of a detergent bar wherein the soap is at least partially in beta-phase form. Beta-phase soap crystals have a smaller lattice dimension than delta and omega soap phases and are associated with a typifying 6.35 cm X-ray diffraction ring, the relative amount of beta-phase being determined by comparing the ring intensity against that of known standard mixtures. In this aspect of the invention, therefore, the soap is preferably at least about 20%, more preferably at least about 50% and especially at least about 70% in the beta-phase form. In highly preferred compositions, the bar is a milled toilet bar and is transparent or translucent in the sense described in U.S. Pat. No. 2,970,116. It is a feature of the present invention that the water-insoluble silica or silicate can be incorporated in such bars without loss of transparency.

The soap fat stock for making bars which are predominantly beta-phase is of some importance and desirably the fat stock comprises no more than about 40% thereof of saturated fatty acids of less than 16 carbon atoms and at least about 20% thereof of saturated fatty acids of from 16 to 22 carbon atoms. In preferred compositions, the fat stock comprises no more than about 30% of the shorter chain saturated fatty acids and at least about 70% of the longer chain saturated fatty acids. The moisture content of the finished beta-phase bar is generally from about 15% to about 26% by weight, preferably from about 20% to about 24%.

The detergent bars of the invention in beta-phase form can again contain free fatty acids, in addition to the neutralized fatty acids which form the actual soap component. Free fatty acids are especially valuable as plasticizers. Without the free fatty acids, some bars have a greater tendency to form wet cracks. The free fatty acid content should be restricted to less than about 1%–2% by weight, however.

An essential component of the present compositions is a water-insoluble synthetic amorphous silica or silicate having a specific surface area of at least about 25 square meters per gram. This is generally present in a range from about 0.1% to about 3.5%, preferably from about 0.8% to about 2.5% by weight of the bar. Outside these limits, the lathering benefit of the silica or silicate is increasingly lost. Moreover, it becomes increasingly difficult to prepare compositions in beta-phase form at higher levels and it is therefore important that the level of silica or silicate be chosen accordingly.

Although synthetic amorphous silicas are preferred herein, water-insoluble synthetic, amorphous silicates which contain at least about 40%, preferably at least about 75% of silica and additionally contain up to about 40% by weight thereof of aluminium or zinc (oxide basis), up to about 25% by weight of alkali metal (oxide basis), and/or up to about 35% magnesium or calcium (oxide basis) are also suitable. Highly preferred silicas or silicates are wet-agglomerated materials and have a secondary particle size of from about 1 to about 40 micrometers, especially from about 3 to about 35 micrometers. The secondary particle size is found to have a strong influence on the character of the lather produced by the bar, silica having a secondary particle size of from about 25 to about 35 micrometers giving a lather with more open bubbles than silicas having a secondary particle size of from about 3 to about 20 micrometers. Suitably, the silica or silicate also has a specific surface area in the range from about 100 to about 1000 square meters/gram, preferably from about 120 to about 300 square meters/gram and a pore volume of from about 0.4 to about 4.4 ml/g, preferably from about 0.5 to about 1.4 ml/g. In the case of transparent detergent bar compositions, moreover, the silica and silicate preferably has a refractive index from about 1.4 to about 1.6, more preferably from about 1.45 to about 1.55.

In the above, the specific surface area of the silica or silicate is determined by the nitrogen absorption method of Brunauer, Emmett and Teller in Journal of the American Chemical Society, 60, 309, (1938). The pore volume is determined using a mercury porosimeter and is the volume of pores of diameter greater than 25 millimicrons.

Specific types of silica or silicate suitable herein include precipitated silica, silica gel, silica xerogel, silica aerogel, mixed silica/alumina gels, precipitated sodium alumino silicate, sodium aluminosilicate gels and precipitated calcium silicate. The precipitated silicas are especially preferred.

In addition to the components described above, the detergent bars of the present invention can contain a wide variety of optional materials. These optional materials include, for example, skin conditioning components, processing aids, anti-bacterial agents and sanitizers, dyes, perfumes and coloring agents.

Materials to facilitate the preparation of the instant detergent bars can also be present. Thus, glycerine, for example, can be added to the crutcher or amalgamator in order to facilitate processing. Glycerine, if present, generally comprises from about 0.2% to about 10% by weight of the finished bar. Additionally, emulsifiers such as polyglycerol esters (e.g. polyglycerol monostearate), propylene glycol esters and other chemically stable nonionic materials may be added to the bars to help solubilize various components, particularly skin conditioning agents, such as sorbitan esters.

Conventional anti-bacterial agents and sanitizers can be added to the bars of the present invention. Typical anti-bacterial sanitizers include 3,4-di- and 3',4',5-tribromosalicyl-anilides; 4,4'-dichloro-3-(trifluoromethyl)-carbanalide; 3,4,4'-tri-chlorocarbanalide and mixtures of these materials. Use of these materials in soap bars is described in more detail in U.S. Pat. No. 3,256,200. If present, anti-bacterial agents and sanitizers generally comprise from about 0.5% to about 4% by weight of the finished bar.

The bars of the present invention can optionally contain various emollients and skin conditioning agents. Materials of this type include, for example, sorbitan esters, such as those described in U.S. Pat. No. 3,988,255, lanolin, cold cream, mineral oil, isopropyl myristate, and similar materials. If present, such emollients and skin conditioning agents generally comprise from about 0.5% to about 5% by weight of the bar.

The detergent bars herein can also contain an electrolyte as described in U.S. Pat. No. 2,686,761 and No. EP-A-14502. Suitable electrolytes include sodium chloride, potassium chloride, potassium carbonate, dipotassium monohydrogen orthophosphate, tetrasodium pyrophosphate, tetrapotassium pyrophosphate, sodium tripolyphosphate, potassium tripolyphosphate, trisodium orthophosphate, tripotassium orthophosphate, and sodium and/or potassium formates, citrates, acetates and tartrates, and mixtures of the above. The electrolyte level is from about 0.2% to about 4.5%.

Acidic materials can be added to the bar to control free alkalinity. A suitable example is citric acid added at a level of about 0.1% to about 3%.

Another preferred ingredient of the compositions of the invention, especially those comprising soap in beta-phase form, is a pearlescent material such as mica, titanium-dioxide coated mica, natural fish silver, or heavy metal salts such as bismuth oxychloride. It is a feature of the invention that the silica or silicate described herein can be incorporated in such compositions without detriment to the development of pearlescence.

The detergent bars can also contain any of the conventional perfumes, dyes and coloring agents generally utilized in commercially-marketed bars to improve the characteristics of such products. If present, such perfumes, dyes and coloring agents comprise from about 0.2% to about 5% by weight of the bar.

The compositions of the invention are prepared in conventional manner, either from neat kettle soap or from saponified touch-hardened fatty acid blends. Typically, a base soap in the form of noodles containing soap, free fatty acid sodium chloride is mixed with the silica or silicate and remaining ingredients in an amalgamator, followed by milling at a temperature of from about 43° C. to about 60° C. In a typical process for making beta-phase compositions, neat kettle soap containing from about 28% to about 34%, preferably from about 30% to about 32% moisture is dried, preferably by Mazzoni spray drying, to a moisture content of from about 15% to about 26%, preferably from about 19% to about 25%, more preferably from about 21% to about 23% by weight of the soap mix and the dried soap is mechanically worked at an elevated temperature, for example, in an amalgamator or over milling rolls, until the temperature is raised into the range from about 27° C. to about 51° C., preferably from about 37° C. to about 43° C., more preferably from about 39° C. to about 41° C. Thereafter, the soap mass is plodded into bar form. The silica or silicate component and optional bar components, other than perfume, dye and pearlescer, are preferably admixed with the neat kettle soap prior to the drying stage.

In the examples which follow, the following abbreviations have been made.

S1: Neosyl (RTM) GP, precipitated silica supplied by Joseph Crosfield, secondary particle size 6.5 microns, refractive index 1.45.

S2: Alusil (RTM) AS, precipitated sodium aluminosilicate having $SiO_2$:$Al_2O_3$:$Na_2O$ of 14:1:1.6, supplied by Joseph Crosfield.

S3: Sident (RTM) 12, precipitated silica supplied by Degussa having secondary particle size of 10 microns.

S4: Microcal 160, precipitated calcium silicate having $SiO_2$:CaO of 3.66:1, refractive index 1.47, supplied by Joseph Crosfield.

S5: Precipitated silica, secondary particle size 6–12 microns.

S6: Precipitated silica, secondary particle size 25–35 microns.

EXAMPLES I TO VI

Soap bar compositions according to the invention are prepared as described above in which sodium tallow/coconut (80/20) kettle soap is mixed with all remaining ingredients, apart from perfume, dye, $TiO_2$ and mica, the mixture is dried in a Mazzoni spray dryer, the dried soap mixture is admixed with the remaining components in an amalgamator, then milled at about 40° C. to optimize beta-phase soap formation, and finally plodded into bar form. The compositions are as follows:

| | I | II | III | IV | V | VI |
|---|---|---|---|---|---|---|
| Sodium tallow/coconut (80/20) soap (anhydrous) | 69 | 70.3 | 66.6 | 70.5 | 69.8 | 65 |
| Potassium tallow soap | — | — | — | 3 | — | 4 |
| Tripotassium citrate monohydrate | — | 2 | 2.5 | 1.5 | — | 3 |
| Sodium chloride | 2.5 | 0.8 | 0.4 | 0.3 | 0.6 | 0.5 |
| Glycerine | — | 3 | 4 | — | 5 | 5 |
| EDTA | 0.1 | 0.3 | 0.2 | 0.1 | 0.2 | 0.1 |
| Lauric Acid | 0.5 | 0.2 | 0.8 | 0.5 | 0.6 | 1 |
| $TiO_2$ coated mica | 0.1 | 0.1 | 0.1 | 0.1 | 0.1 | — |
| $TiO_2$- | — | — | — | — | 0.2 | |
| Perfume and dye | 2 | 1.3 | 1.4 | 1 | 2.2 | 1.9 |
| S1 | — | — | 2 | — | — | 1.8 |
| S2 | — | 1 | — | — | — | — |
| S3 | 2 | — | — | 1.5 | — | — |
| S4 | — | — | — | — | 2.5 | — |

-continued

| | I | II | III | IV | V | VI |
|---|---|---|---|---|---|---|
| Moisture | 23.8 | 21 | 22 | 21.5 | 18.8 | 17.7 |

The above compositions are beta-phase toilet soaps having improved lathering characteristics, both in soft and hard water, as well as reduced smear, improved cleansing performance, and enhanced skin-feel characteristics.

EXAMPLES VI TO XI

Soap bar compositions according to the invention are prepared by saponifying touch-hardened tallow/-coconut fatty acid blends with caustic alkali followed by salt and free fatty acid addition to produce base soap having approximately 70% real soap content, drying the base soap, amalgamating the dried soap with all remaining components, milling and plodding into bars in usual manner.

| | VI | VII | VIII | IX | X | XI |
|---|---|---|---|---|---|---|
| Sodium tallow/ coconut (80/20) soap | — | 83.3 | — | 86.1 | 77.1 | — |
| Sodium tallow/ coconut (50/50) soap (I.V. about 25) | 80.8 | — | 81.9 | — | — | 78.1 |
| Sodium chloride | 0.4 | 1 | 0.6 | 0.5 | 1 | 1.1 |
| Coconut fatty acid | 5 | — | 3 | — | 7 | 7 |
| EDTA | 0.2 | 0.1 | 0.1 | 0.2 | 0.2 | 0.1 |
| $TiO_2$ | 0.1 | 0.3 | 0.2 | 0.3 | 0.2 | 0.2 |
| Perfume and dye | 2 | 1.8 | 1.2 | 1.9 | 1.5 | 1.5 |
| $S_1$ | 2.5 | — | — | — | — | — |
| $S_2$ | — | 1.5 | — | — | — | — |
| $S_3$ | — | — | 2 | — | — | — |
| $S_4$ | | | | 1 | — | — |
| $S_5$ | — | — | — | — | 2 | — |
| $S_6$ | — | — | — | — | — | 2 |
| Moisture | 9 | 12 | 11 | 10 | 11 | 10 |

The above compositions are omega phase soaps having improved lathering characteristics, both in soft and hard water, improved cleansing performance and enhanced skin-feel characteristics.

What is claimed is:

1. A translucent or transparent milled toilet bar composition comprising from about 45% to about 95% alkali metal soap and from about 0.1% to about 3.5% of water-insoluble synthetic amorphous particulate silica or silicate having a specific surface area of at least about 25 square meters per gram, at least about 50% of the said soap being in the beta phase.

2. A composition according to claim 1, wherein at least about 70% by weight of the soap is in the beta-phase.

3. A composition according to claim 1 characterized by soap of a fat stock no more than about 40% of which are saturated fatty acids of less than 16 carbon atoms and at least about 20% of which are saturated fatty acids of from 16 to 22 carbon atoms.

4. A composition according to claim 3 having a water content of from 15% to 26% by weight.

5. A composition according to claim 1 wherein the silica or silicate comprises up to about 40% by weight of aluminium or zinc (oxide basis), up to about 25% by weight of alkali metal (oxide basis), and up to about 35% by weight magnesium or calcium (oxide basis).

6. A composition according to claim 1 wherein the silica or silicate is wet-agglomerated.

7. A composition according to claim 1 wherein the silica or silicate is selected from the group consisting of precipitated silica, silica gel, silica xerogel, silica aerogel, mixed silica/alumina gels, precipitated sodium aluminosilicate, sodium aluminosilicate gels, precipitated calcium silicate and mixtures thereof.

8. A composition according to any of claims 1, 2, 3, 4, 5, 6 or 7 wherein the silica or silicate has a refractive index in the range from about 1.4 to about 1.6.

9. A composition according to claim 8 comprising from about 0.5% to about 2.5% silica or silicate.

10. A composition according to claim 8 wherein the silica or silicate has a specific surface area in the range from about 100 to about 1000 square meters/gram, a pore volume of from about 0.4 to about 4.4 ml/g and an average secondary particle size of from about 1 to about 40 micrometers.

* * * * *